US009597872B2

(12) United States Patent
Mizukami

(10) Patent No.: US 9,597,872 B2
(45) Date of Patent: Mar. 21, 2017

(54) DROPLET DISCHARGE HEAD AND IMAGE FORMING APPARATUS INCORPORATING SAME

(71) Applicant: Satoshi Mizukami, Kanagawa (JP)

(72) Inventor: Satoshi Mizukami, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/044,311

(22) Filed: Feb. 16, 2016

(65) Prior Publication Data

US 2016/0236470 A1 Aug. 18, 2016

(30) Foreign Application Priority Data

Feb. 16, 2015 (JP) ..... 2015-027816

(51) Int. Cl.
*B41J 2/16* (2006.01)
*B41J 2/14* (2006.01)

(52) U.S. Cl.
CPC ..... *B41J 2/14233* (2013.01); *B41J 2/161* (2013.01); *B41J 2/1629* (2013.01); *B41J 2/1631* (2013.01);
(Continued)

(58) Field of Classification Search
CPC ..... B41J 2/14233; B41J 2/161; B41J 2/164; B41J 2002/14266; B41J 2002/14241; B41J 2/14201
See application file for complete search history.

(56) References Cited

U.S. PATENT DOCUMENTS 6,447,106 B1 * 9/2002 Watanabe ..... B41J 2/14233 347/70
2002/0051039 A1 * 5/2002 Moynihan ..... A01K 15/025 347/68

(Continued)

FOREIGN PATENT DOCUMENTS

JP 2000-141643 5/2000
JP 2004-042329 2/2004

(Continued)

*Primary Examiner* — Manish S Shah
*Assistant Examiner* — Yaovi M Ameh
(74) *Attorney, Agent, or Firm* — Cooper & Dunham LLP

(57) ABSTRACT

A droplet discharge head includes a nozzle, a substrate, a diaphragm, and an electromechanical transducer element. The nozzle discharges droplets. The substrate includes a pressurization chamber communicated with the nozzle. The diaphragm is disposed on the substrate. The electromechanical transducer element is disposed on the diaphragm. The electromechanical transducer element includes an electromechanical transducer film, a lower electrode, and an upper electrode. The electromechanical transducer film includes a piezoelectric material. The lower electrode is disposed below the electromechanical transducer film, to apply voltage to the electromechanical transducer film. The upper electrode is disposed above the electromechanical transducer film, to apply voltage to the electromechanical transducer film. The diaphragm includes an $SiO_2$ film, an SiN film, and a Poly-Si film laminated one on another. The diaphragm has, in a direction of lamination, a thickness of not less than 1 μm and not greater than 3 μm. The diaphragm has a deflection projecting toward the pressurization chamber with no voltage applied to the electromechanical transducer film. A radius of curvature of the deflection in a transverse direction of the diaphragm is in a range of not less than 2000 μm and not greater than 6000 μm.

12 Claims, 9 Drawing Sheets

(52) U.S. Cl.
CPC ..... *B41J 2/1642* (2013.01); *B41J 2/1645* (2013.01); *B41J 2/1646* (2013.01); *B41J 2/14201* (2013.01); *B41J 2002/14241* (2013.01); *B41J 2002/14258* (2013.01); *B41J 2002/14266* (2013.01); *B41J 2202/03* (2013.01)

(56) References Cited

U.S. PATENT DOCUMENTS

| | | | | |
|---|---|---|---|---|
| 2006/0290747 | A1 * | 12/2006 | Shimada | B41J 2/14233 347/68 |
| 2011/0090289 | A1 | 4/2011 | Mizukami | |
| 2012/0206545 | A1 | 8/2012 | Kato et al. | |
| 2012/0212545 | A1 | 8/2012 | Mizukami et al. | |
| 2012/0229573 | A1 | 9/2012 | Mizukami et al. | |
| 2012/0236083 | A1 | 9/2012 | Mizukami et al. | |
| 2013/0002767 | A1 | 1/2013 | Mizukami et al. | |
| 2013/0070029 | A1 | 3/2013 | Mizukami et al. | |
| 2013/0162726 | A1 | 6/2013 | Mizukami et al. | |
| 2013/0250007 | A1 | 9/2013 | Ishimori et al. | |
| 2013/0250009 | A1 | 9/2013 | Ishimori et al. | |
| 2015/0077475 | A1 | 3/2015 | Mizukami et al. | |
| 2015/0266296 | A1 | 9/2015 | Mizukami et al. | |
| 2015/0349240 | A1 | 12/2015 | Mizukami | |

FOREIGN PATENT DOCUMENTS

| | | | | |
|---|---|---|---|---|
| JP | 2005-280247 | | 10/2005 | |
| JP | 2009-178982 | | 8/2009 | |
| JP | 2011-056913 | | 3/2011 | |
| JP | 2013-065670 | | 4/2013 | |
| JP | 2013-201198 | | 10/2013 | |
| JP | 2013-538446 | | 10/2013 | |
| JP | 2014-151511 | | 8/2014 | |
| JP | 2014-151511 | A * | 8/2014 | B41J 2/045 |
| WO | WO2012/018561 | A1 | 2/2012 | |

* cited by examiner

DROPLET DISCHARGE HEAD AND IMAGE FORMING APPARATUS INCORPORATING SAME

CROSS-REFERENCE TO RELATED APPLICATION

This patent application is based on and claims priority pursuant to 35 U.S.C. §119(a) to Japanese Patent Application No. 2015-027816, filed on Feb. 16, 2015, in the Japan Patent Office, the entire disclosure of which is hereby incorporated by reference herein.

BACKGROUND

Technical Field

Aspects of the present disclosure relate to a droplet discharge head and an image forming apparatus incorporating the droplet discharge head.

Related Art

An image forming apparatus, such as a printer, a facsimile machine, and a copier, is known to have a droplet discharge head to discharge droplets of liquid, e.g., ink for image formation. The droplet discharge head includes, e.g., nozzles to discharge droplets, liquid chambers formed by processing a substrate and communicated with the nozzles, and pressure generators to generate pressure in liquid in the liquid chambers. As the pressure generator, the droplet discharge head includes, for example, a piezo-type electromechanical transducer element in which a lower electrode, an electromechanical transducer film made of a piezoelectric material, and so on are laminated one on another on a diaphragm constituting part of a wall of a liquid chamber. When a voltage is applied to the electromechanical transducer element via the lower electrode and the upper electrode, the electromechanical transducer element deforms. Such deformation displaces a chamber-side surface of the diaphragm having the electromechanical transducer element, thus generating pressure in liquid in the liquid chamber.

SUMMARY

In an aspect of the present disclosure, there is provided a droplet discharge head that includes a nozzle, a substrate, a diaphragm, and an electromechanical transducer element. The nozzle discharges droplets. The substrate includes a pressurization chamber communicated with the nozzle. The diaphragm is disposed on the substrate. The electromechanical transducer element is disposed on the diaphragm. The electromechanical transducer element includes an electromechanical transducer film, a lower electrode, and an upper electrode. The electromechanical transducer film includes a piezoelectric material. The lower electrode is disposed below the electromechanical transducer film, to apply voltage to the electromechanical transducer film. The upper electrode is disposed above the electromechanical transducer film, to apply voltage to the electromechanical transducer film. The diaphragm includes an $SiO_2$ film, an SiN film, and a Poly-Si film laminated one on another. The diaphragm has, in a direction of lamination, a thickness of not less than 1 μm and not greater than 3 μm. The diaphragm has a deflection projecting toward the pressurization chamber with no voltage applied to the electromechanical transducer film. A radius of curvature of the deflection in a transverse direction of the diaphragm is in a range of not less than 2000 μm and not greater than 6000 μm.

In another aspect of the present disclosure, there is provided an image forming apparatus that includes the droplet discharge head.

In still another aspect of the present disclosure, there is provided a method of producing the droplet discharge head according. The method includes generating charge by corona discharge, and injecting the charge into the electromechanical transducer element to polarize the electromechanical transducer element.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
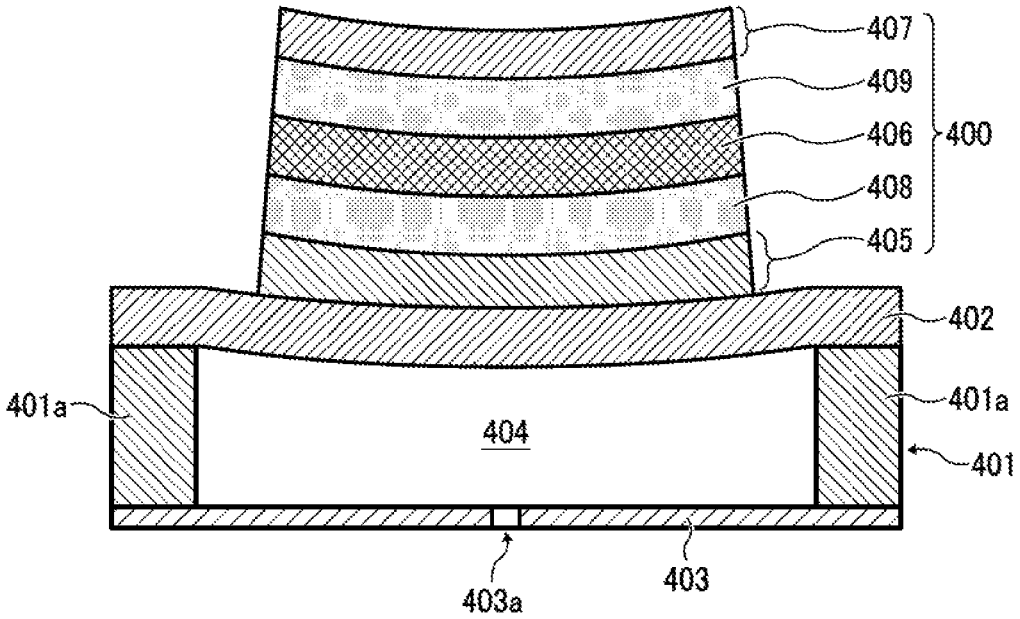
FIG. 1 is a cross-sectional view of an example of a configuration of a droplet discharge head according to an embodiment of the present disclosure.

The accompanying drawings are intended to depict example embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Below, an inkjet recording apparatus having a liquid discharge head is described as an example of an image forming apparatus according to an embodiment of the present disclosure.

Note that, in the following descriptions, the term {hkl} plane is representative of an (hkl) plane and a plurality of crystal planes equivalent to the (hkl) plane from a symmetry without considering a direction of voluntary polarization in crystallization of a piezoelectric material. The {hkl} plane may be any one crystal plane of the (hkl) plane and the plurality of crystal planes equivalent to the (hkl) plane or any two or more crystal planes selected from the (hkl) plane and the plurality of crystal planes equivalent to the (hkl) plane. For example, in an electromechanical transducer film having a crystal structure of perovskite, the term {100} plane represents any one plane or any two or more crystal planes of a plurality of crystal planes including a (100) plane and other five crystal planes equivalent to the (100) plane. In this specification, the peak of diffraction intensity represents a convex portion of a diffraction intensity curve obtained by of X-ray diffraction measurement, not a maximum value of diffraction intensity.

Inkjet recording apparatuses have many advantages, such as extremely noiseless operation, high-speed printing, a high degree of flexibility in ink, i.e., liquid for image formation, and availability of low-cost plain paper. Accordingly, inkjet recording apparatuses are widely used as image forming apparatuses, such as printers, facsimile machines, and copiers.

A droplet discharge head used in such an inkjet recording apparatus includes, for example, nozzles to discharge droplets of liquid (ink) for image formation, pressurization chambers communicated with the nozzles, and pressure generators to generate pressure to discharge ink from the pressurization chambers. A pressure generator according to this embodiment is a piezo-type pressure generator including a diaphragm and an electromechanical transducer element. The diaphragm constitutes part of a wall of a pressurization chamber, and the electromechanical transducer element includes a thin electromechanical transducer film made of a piezoelectric material to deform the diaphragm. When a predetermined voltage is applied to the electromechanical transducer element, the electromechanical transducer element deforms to displace a surface of the diaphragm toward the pressurization chamber, thus generating pressure in liquid in the pressurization chamber. The pressure allows liquid droplets (ink droplets) to be discharged from a nozzle communicated with the pressurization chamber.

The piezoelectric material constituting the electromechanical transducer film is made of a material having piezoelectric properties of being deformed by application of voltage. In this embodiment, as the piezoelectric material, lead zirconate titanate (PZT: $Pb(Zr_x,Ti_{1-x})O_3$) is used that is a ternary metal oxide having a crystal structure of perovskite. There are a plurality of types of vibration modes on application of a drive voltage to the electromechanical transducer element including the electromechanical transducer film made of PZT (hereinafter, PZT film). Examples of variation modes include a vertical vibration mode (push mode) involving deformation in a film thickness direction with piezoelectric constant d33, a lateral vibration mode (bend mode) involving bending deformation with piezoelectric constant d31, and a shear mode utilizing shearing deformation of film.

For the electromechanical transducer element including the PZT film, as described below, pressurization chambers and electromechanical transducer elements can be directly built-in a Si substrate by using technologies of semiconductor processing and micro electro mechanical systems (MEMS). Accordingly, the electromechanical transducer elements can be formed as thin-film piezoelectric actuators to generate pressure in the pressurization chambers.

Next, an example of a structure of a droplet discharge head including an electromechanical transducer element 400 according to an embodiment of the present disclosure. FIG. 1 is a cross-sectional view of an example of a configuration of a droplet discharge head according to this embodiment. The droplet discharge head according to this embodiment includes, for example, a substrate 401, a diaphragm 402, a nozzle plate 403, a pressurization chamber (pressure chamber) 404, a first electrode 405 as a lower electrode, a PZT film 406 as an electromechanical transducer film, and a second electrode 407 as an upper electrode. The pressurization chamber 404 is formed so as to be surrounded with partitions 401*a* formed in the substrate 401, the diaphragm 402, and the nozzle plate 403. The pressurization chamber 404 is communicated with a nozzle 403*a* of the nozzle plate 403.

A silicon single crystal substrate is preferably used as the substrate 401 and a thickness of the substrate 401 is preferably in a range of not less than 100 μm and not greater than 600 μm in general. As the surface of the substrate 401, three types of planes of {100} plane, {110} plane, and {111} plane are known. However, generally {100} plane and {111} plane are widely used in the semiconductor industry. In this embodiment, a single crystal substrate having mainly a {100} plane on a surface of the substrate is used.

In fabricating the pressurization chamber 404 as illustrated in FIG. 1, a monocrystalline silicon substrate is processed by etching. In such a case, the anisotropic etching is typically used as a method of etching. The anisotropic etching utilizes the property that the etching rate is different between a plurality of types of planes of a crystal structure. For example, in the anisotropic etching in which the substrate is immersed in an alkaline solution, such as KOH, the etching rate of a (111) plane is about 1/400 of the etching rate of a (100) plane. Therefore, a structural body having an inclination of about 54° in the (100) plane can be produced. On the other hand, for the {110} plane, deep grooves can be formed, thus allowing an increase in array density while maintaining rigidity. In this embodiment, a monocrystalline substrate having a surface of a {110} plane may be used. In this case, however, because $SiO_2$ to be a mask material may also be etched, the single crystal substrate having the surface of the (110) plane is used in consideration of the above point.

The width of the pressurization chamber 404 is preferably not less than 50 μm and not greater than 70 μm, and is more preferably not less than 55 μm and not greater than 65 μm. When the width of the pressurization chamber 404 is greater than 70 μm, the residual vibration of the diaphragm 402 becomes large and may hamper securing the discharging performance of the droplet discharge head at high frequency. When the width of the pressurization chamber 404 is less than 50 μm, the amount of displacement decreases, thus hampering securing a sufficient level of discharging voltage.

By receiving a force generated by the PZT film 406, the diaphragm 402 deforms and displaces the surface of the diaphragm 402. The displacement generates pressure in liquid in the pressurization chamber 404 to discharge droplets from the nozzle 403*a*. Therefore, the diaphragm 402 preferably has a predetermined hardness. As the materials of the diaphragm 402, for example, Si, $SiO_2$, and $Si_3N_4$ are prepared according to a chemical vapor deposition (CVD) method.

In addition, materials having linear expansion coefficients close to a linear expansion coefficient of each of the first electrode 405 and the PZT film 406 are preferably selected as the materials of the diaphragm 402. In particular, typically, PZT is used as a material of the PZT film 406. Accordingly, the materials of the diaphragm 402 preferably have a linear expansion coefficient close to a linear expansion coefficient of $8\times10^{-6}$ [l/K], in other words, a linear expansion coefficient of not less than $5\times10^{-6}$ [l/K] and not greater than $10\times10^{-6}$ [l/K]. More preferably, the materials of the diaphragm 402 preferably have a linear expansion coefficient of not less than $7\times10^{-6}$ [l/K] and not greater than $9\times10^{-6}$ [l/K].

Examples of the materials of the diaphragm 402 include aluminum oxide, zirconium oxide, iridium oxide, ruthenium oxide, tantalum oxide, hafnium oxide, osmium oxide, rhenium oxide, rhodium oxide, palladium oxide, and compounds of the foregoing materials. Using such materials, the diaphragm 402 can be produced by a spin coater using a sputtering method or a sol-gel method. The film thickness of the diaphragm 402 is preferably in a range of not less than 1 μm and not greater than 3 μm and is more preferably in a range of not less than 1.5 μm and not greater than 2.5 μm. If the film thickness of the diaphragm 402 is less than 1 μm, the pressurization chamber 404 may not be easily processed. If the film thickness of the diaphragm 402 is greater than 3 μm, the diaphragm 402 may be less deformed and displaced, thus hampering stable discharge of ink droplets.

The diaphragm 402 is desirably constructed by laminating a plurality of films having tensile stress or compressive stress according to a low pressure (LP) CVD method. A reason thereof is as follow. When the diaphragm 402 is made of a monolayer film, for example, an SOI wafer is used as a material. In such a case, the cost of the wafer is quite high. Even if the wafer is processed to have a flexural rigidity, a given membrane stress may not set to the wafer. By contrast, when the diaphragm 402 is made of laminated layers, the flexibility in setting the rigidity and membrane stress of the diaphragm 402 to desired values can be obtained by optimizing the configuration of the laminated layers. Accordingly, the control of the entire rigidity and membrane stress of the diaphragm 402 can be achieved through a combination of lamination of layers, film thickness, and the configuration of laminated layers.

Such a configuration can appropriately correspond to the materials and film thickness of electrode layers and a ferroelectric layer constituting a piezoelectric actuator (piezoelectric element). Such a configuration also provide the stable diaphragm 402 that less fluctuates in rigidity and stress of the diaphragm 402 due to the sintering temperature of the piezoelectric actuator (piezoelectric element). Accordingly, a stable droplet discharge head can be provided that has a highly-precise droplet discharge property.

The first electrode 405 as the lower electrode is a layer of metal material. As the metal material, for example, platinum having high heat resistance and low reactivity is typically used. However, platinum may not have a sufficient barrier property against lead, and platinum group elements, such as iridium and platinum-rhodium, or alloy films thereof may be used. When platinum is used, adhesion of platinum with a base (in particular, Sift) is poor. Therefore, for example, Ti, $TiO_2$, Ta, $Ta_{205}$, or $Ta_3N_5$ is preferably laminated in advance. As a method of producing the first electrode 405, vacuum film formation, such as a sputtering method or a vacuum vapor deposition method is generally used. The film thickness of the first electrode 405 is preferably in a range of not less than 0.02 μm and not greater than 0.1 μm and is more preferably in a range of not less than 0.05 μm and not greater than 0.1 μm. In consideration of fatigue property over time of the deformation of the PZT film 406, for example, a first oxide layer 408 made of a conductive oxide, such as strontium ruthenate, is preferably interposed between the first electrode 405 and the PZT film 406.

The first oxide layer 408 influences the orientation of the PZT film 406 to be formed on the first oxide layer 408. Accordingly, the material of the first oxide layer 408 is properly selected in accordance with the plane orientation of the PZT film 406 to be preferentially oriented. In this embodiment, the plane orientation of the PZT film 406 to be preferentially oriented is {100} plane, and, for example, $LaNiO_3$, $TiO_2$, and lead titanate ($PbTiO_3$) are selected as the materials of the first oxide layer 408. The film thickness of the first oxide layer 408 is preferably not less than 20 nm and not greater than 80 nm, and more preferably, not less than 30 nm and not greater than 50 nm. If the film thickness is less than 20 nm, sufficient properties are not obtained in the initial displacement or the deterioration of displacement. If the film thickness is greater than 80 nm, the dielectric strength voltage of the piezoelectric layer (PZT film) subsequently formed is very low and leakage occurs easily.

Like the first electrode 405, the material of the second electrode 407 as the upper electrode may also be a metal material, such as platinum, and a second oxide layer 409 may be interposed between a platinum layer and the PZT film 406 to secure good adhesion. The second oxide layer 409 is constructed by laminating conductive oxide, such as strontium ruthenate.

The PZT film 406 is a piezoelectric material having a crystal structure of perovskite and a solid solution of lead zirconate ($PbZrO_3$) and lead titanium oxide ($PbTiO_3$) and has a different property according to the ratio of lead zirconate ($PbZrO_3$) and lead titanium oxide ($PbTiO_3$). When the ratio of $PbZrO_3$ and $PbTiO_3$ is 53:47, the PZT film 406 has a generally excellent piezoelectric property. The composition is represented by a chemical formula of Pb $(Zr_{0.53}Ti_{0.47})O_3$, generally, PZT(53/47) An example of composite oxide other than the PZT includes barium titanate. In such a case, barium alkoxide and titanium alkoxide compounds are used as a starting material and are dissolved in a common solvent, to prepare a barium titanate precursor solution.

In the PZT film 406, when the {100} plane is preferentially oriented, the composition ratio of Zr and Ti represented by Ti/(Zr+Ti) is preferably not less than 0.45 and not greater than 0.55 to maintain 20 within the range. More preferably, the composition ratio of Zr and Ti is not less than 0.48 and not greater than 0.52.

I{hkl} represents an integral value of diffraction intensity at a peak of diffraction intensity corresponding to a {hkl} plane a positive integer, where h, k, and l are given positive integers. Σ{hkl} represents a total sum of I{hkl}. The ratio ρ{hkl} of I{hkl} to Σ{hkl} (ρ{hkl}=I{hkl}/Σ{hkl}) represents the degree of orientation on the {hkl} plane. The value of ρ{hkl} is preferably not less than 0.75, and more preferably, not less than 0.85. If ρ{hkl} is less than 0.75, a sufficient degree of strain deformation due to piezoelectric effect may not be obtained, thus hampering securing of a sufficient amount of displacement of the electromechanical transducer element 400.

The materials are represented by a general formula $ABO_3$ and composite oxides including A=Pb, Ba, and Sr, and B=Ti, Zr, Sn, Ni, Zn, Mg, and Nb as main components correspond to the materials. For example, chemical formulas of the composite oxides are represented by $(Pb_{1-x}, Ba_x)$ (Zr, Ti)$O_3$ or (Pb) $(Zr_x, Ti_y, Nb_{1-x-y})O_3$. The chemical formulas show an example when Pb of the A site is partially substituted with Ba and an example when Zr and Ti of the B site is partially substituted with Nb. Such substitution is possible for divalent elements and is performed in material modification for application of the deformation property (displacement property) of PZT. An effect of the substitution is to reduce the deterioration of deformation property (displacement property) due to the evaporation of the lead during heat treatment. As a producing method, the composite oxides can be produced by a spin coater using a sputtering method or a sol-gel method. In such a case, patterning is performed by, e.g., photolithoetching to obtain a desired pattern.

When the PZT film 406 is produced by the sol-gel method, for example, lead acetate, zirconium alkoxide, and titanium alkoxide compounds are used as starting materials and are dissolved in methoxyethanol functioning as a common solvent and a uniform solution is obtained. Thereby, a PZT precursor solution can be prepared. A metal alkoxide compound is likely to be easily hydrolyzed by atmospheric water. Therefore, acetylacetone, acetic acid, diethanolamine functioning as stabilizers may be appropriately added to the PZT precursor solution. When the PZT film is formed on an entire surface of the base substrate, the PZT film is obtained by forming a coating by a solution coating method, such as a spin coating method, and performing each heat treatment of solvent drying, thermal decomposition, and crystallization on the coating. Transformation from the coating to a crystalline film causes volume contraction. Therefore, the concentration of the precursor solution is adjusted to obtain a film thickness of 100 nm or less by one step in order to obtain a crack-free film.

The film thickness of the PZT film 406 is preferably in a range of not less than 1 μm and not greater than 3 μm and is more preferably in a range of not less than 1.5 μm and not greater than 2.5 μm. If the film thickness of the PZT film 406 is less than the preferable range, the pressurization chamber 404 illustrated in FIG. 1 may not be easily processed. If the film thickness is greater than the preferable range, the diaphragm 402 below the PZT film 406 may be less deformed and displaced. Accordingly, the discharge of droplets may become unstable, and a sufficient amount of displacement may not arise. If the film thickness of the PZT film 406 is greater than the preferable range, the number of processing steps may increase to stack many layers one on another and a processing time may increase.

Figure 2:
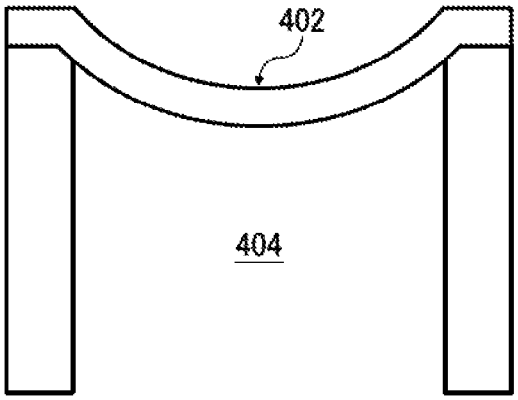
FIG. 2 is an illustration of an example of a state of a diaphragm at an end of production of a pressurization chamber in the production of the droplet discharge head.

FIG. 2 is an illustration of an example of a state of the diaphragm 402 at an end of production of the pressurization chamber 404. As illustrated in FIG. 2, the diaphragm 402 is deflected in a bent shape in which the transverse direction (short direction) of the diaphragm 402 projects toward the pressurization chamber 404. The amount of deflection of the diaphragm 402 in the transverse direction correlates with the radius of curvature of the deflection of the diaphragm 402 in the transverse direction. In other words, the greater the amount of deflection of the diaphragm 402 in the transverse direction, the smaller the radius of curvature of the deflection of the diaphragm 402 in the transverse direction. The smaller the amount of deflection of the diaphragm 402 in the transverse direction, the greater the radius of curvature of the deflection of the diaphragm 402 in the transverse direction. Accordingly, the amount of deflection of the diaphragm 402 in the transverse direction is defined by the radius of curvature of the deflection of the diaphragm 402 in the transverse direction.

Figure 3A:
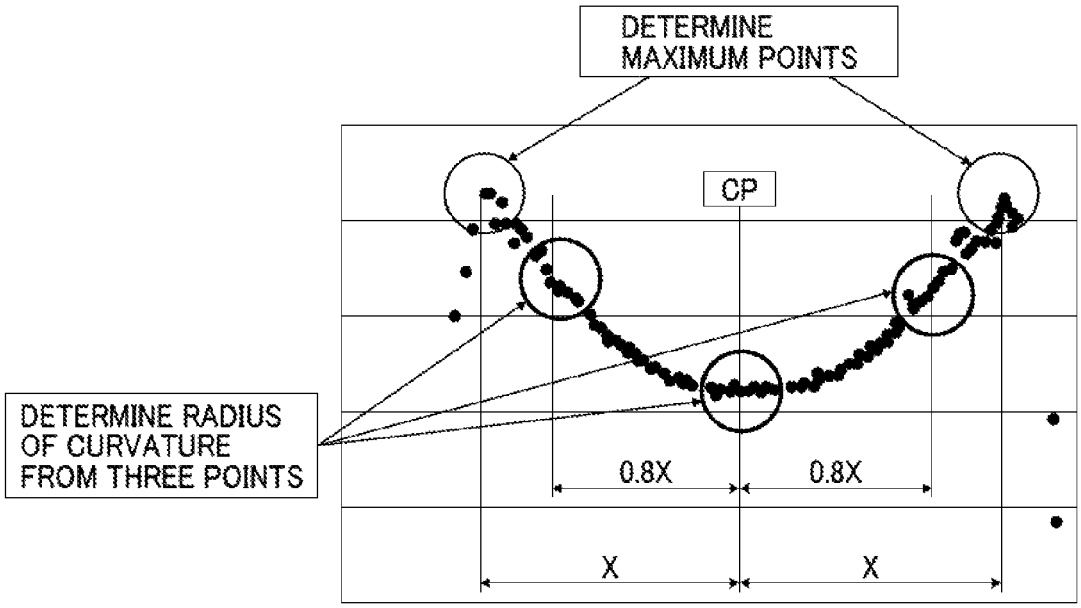
FIGS. 3A and 3B are illustrations of a principle of measuring the radius of curvature of deflection of the diaphragm.
Figure 3B:
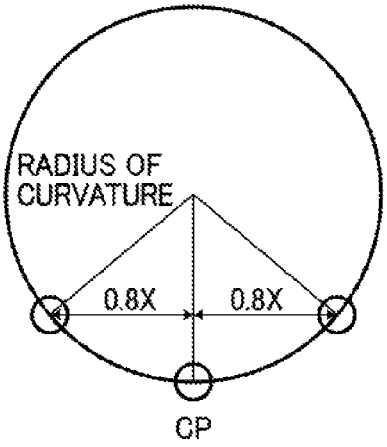

FIGS. 3A and 3B are illustrations of a principle of measuring the radius of curvature of deflection of the diaphragm 402 in the transverse direction. As illustrated in FIG. 3A, in a profile of deflection, maximum points at both ends of the deflection are determined as references, and a central point (a center of deflection) is determined from the maximum points at both ends. When X represents a distance between the central point of the deflection and the maximum point at each end and CP represents the central point of the deflection, coordinates of two points away at a distance of 0.8X from the central point CP are determined as references of coordinates. As illustrated in FIG. 3B, the radius of curvature is determined from the coordinates of the central point CP and the two points at a distance of 0.8X from the central point CP. The profile of deflection of the diaphragm 402 is obtained from a chamber side of the droplet discharge head at which the pressurization chamber 404 is disposed, by measurement of the amount of deflection (with, e.g., CCI3000 manufactured by Ametek Co., Ltd.).

As the residual vibration of the diaphragm in discharging droplets becomes large, a sufficient level of droplet discharging performance is unlikely to be obtained in driving the droplet discharge head at high frequency. To reduce the residual vibration of the diaphragm 402 in discharging ink, the amount of deflection of the diaphragm 402 in the transverse direction preferably decreases (or the radius of curvature of deflection of the diaphragm 402 in the transverse direction increases). The amount of deflection of the diaphragm 402 in the transverse direction (or the radius of curvature of deflection of the diaphragm 402 in the transverse direction) depends on, e.g., the internal stress of the PZT film 406, the internal stress of the diaphragm 402, and the rigidity of each of the PZT film 406, the diaphragm 402, and an insulating protective film. For example, the higher the rigidity of the diaphragm 402, the less the amount of deflection of the diaphragm 402 in the transverse direction (the greater the radius of curvature of deflection of the diaphragm 402 in the transverse direction). In addition, the less the internal stress of the PZT film 406, the less the amount of deflection of the diaphragm 402 in the transverse direction (the greater the radius of curvature of deflection of the diaphragm 402 in the transverse direction).

To enhance the rigidity of the diaphragm 402, Young's modulus or the film thickness is increased. In this embodiment, in consideration of both the internal stress and the rigidity of the diaphragm 402, an $SiO_2$ film, an SiN layer, and a Poly-Si layer are laminated to from the diaphragm 402. The film thickness of $SiO_2$ is preferably not less than 600 μm and not greater than 2400 μm and is more preferably not less than 1000 μm and not greater than 2000 μm. The film thickness of SiN is preferably not less than 100 μm and not greater than 500 μm and is more preferably not less than 200 μm and not greater than 400 μm. The film thickness of Poly-Si is preferably not less than 100 μm and not greater than 700 μm and is more preferably not less than 200 μm and not greater than 600 μm. The film thickness of the diaphragm 402 is not less than 1 μm and not greater than 3 μm. Such a configuration enhances the rigidity of the diaphragm 402 and reduces the residual vibration of the diaphragm 402 in discharging ink, thus securing discharging performance in driving the droplet discharge head at high frequency.

Through experiments, the inventor has found that the degree of deflection of the diaphragm 402 influences the amount of displacement of the electromechanical transducer element 400. For example, as the radius of curvature of deflection of the diaphragm 402 in the transverse direction is set to be greater, the amount of displacement of the electromechanical transducer element 400 increases. As the radius of curvature of deflection of the diaphragm 402 in the transverse direction is set to be smaller, the amount of displacement of the electromechanical transducer element 400 decreases. Accordingly, to set a sufficiently large amount of displacement of the electromechanical transducer element 400 to secure the droplet discharging performance of the droplet discharge head, the radius of curvature of deflection of the diaphragm 402 in the transverse direction is preferably increased to a certain level. However, the inventor has found that, when the radius of curvature of deflection of the diaphragm 402 in the transverse direction is too large, a problem arises in the durability of the electromechanical transducer element 400.

Hence, for the diaphragm 402 having the above-described configuration, the radius of curvature of deflection of the diaphragm 402 in the transverse direction is not less than 2000 μm and not greater than 6000 μm, and more preferably not less than 2500 μm and not greater than 4500 μm. When the radius of curvature of deflection of the diaphragm 402 in the transverse direction is set to be less than 2000 μm, a sufficient displacement in the electromechanical transducer element 400 would not be obtained. By contras, if the radius of curvature of deflection of the diaphragm 402 in the transverse direction is set to be greater than 6000 μm, a failure, such as crack, would be likely to arise in the PZT film 406 when the electromechanical transducer element 400 is continuously driven as the piezoelectric actuator. If such a failure is caused by the continuous driving, the degree of strain deformation after the continuous driving decreases than at an initial stage.

Figure 4:
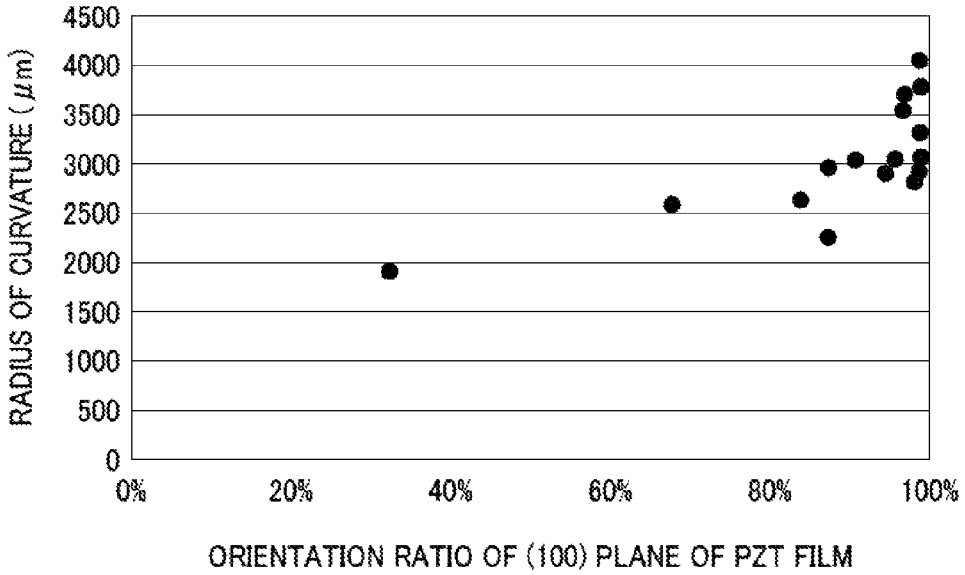
FIG. 4 is a graph of experiment results of the relationship between the orientation rate of {100} plane in a lead zirconate titanate (PZT) film as an electromechanical transducer element of the droplet discharge head and the radius of curvature of the diaphragm.

Through experiments, the inventor has found that, when the PZT film 406 is used as the electromechanical transducer film, the radius of curvature of deflection of the diaphragm 402 in the transverse direction depends on the orientation rate of the {100} plane in the PZT film 406. FIG. 4 is a graph of experiment results of the relationship between the orientation rate of the {100} plane in the PZT film 406 and the radius of curvature of the diaphragm 402. As illustrated in FIG. 4, when the orientation rate of the {100} plane in the PZT film 406 is 70% or greater, the radius of curvature is not less than 2000 μm. When the orientation rate of the {100} plane in the PZT film 406 is close to 100%, the radius of curvature is not less than 2500 μm and not greater than 4500 μm.

Through the above-described experiment results, the inventor has found that setting the preferential orientation plane of the PZT film 406 to the {100} plane allows the radius of curvature to be set to be not less than 2000 μm and not greater than 6000 μm. The radius of curvature of deflection of the diaphragm 402 in the transverse direction (the amount of deflection of the diaphragm 402 in the transverse direction) depends on the internal stress of the PZT film 406. A reason why increasing the orientation rate of the {100} plane in the PZT film 406 allows an increase of the radius of curvature is because the internal stress of the PZT film 406 is reduced.

The orientation rate of the {100} plane in the PZT film 406 significantly influences the temperature of formation of the platinum film applied as the lower electrode (the first electrode 405) and the materials of a seed layer (the first oxide layer 408) formed on the lower electrode. The temperature of formation of the platinum film as the lower electrode is set to be 300 degrees or higher, and $PbTiO_3$ is selected as the material of the seed layer, thus allowing the preferential orientation plane of the PZT film 406 to be set to the {100} plane. Accordingly, the radius of curvature can be set within the above-described range.

The rigidity of the diaphragm 402 influences not only the radius of curvature of the diaphragm 402 but also the frequency characteristics of the droplet discharge head (on whether the head can discharge droplets during driving at high frequency). Accordingly, in producing the diaphragm 402, preferably, the rigidity of the diaphragm 402 is first defined, and the frequency characteristics of the droplet discharge head is determined. As described above, the film thickness of the diaphragm 402 is not less than 1 μm and not greater than 3 μm. At this time, the Young's modulus of the diaphragm 402 is preferably not less than 75 Gpa and not greater than 95 Gpa. Such a configuration allows the droplet discharge head to discharge droplets in driving at a high frequency (for example, a frequency of 32 kHz).

Figure 5A:
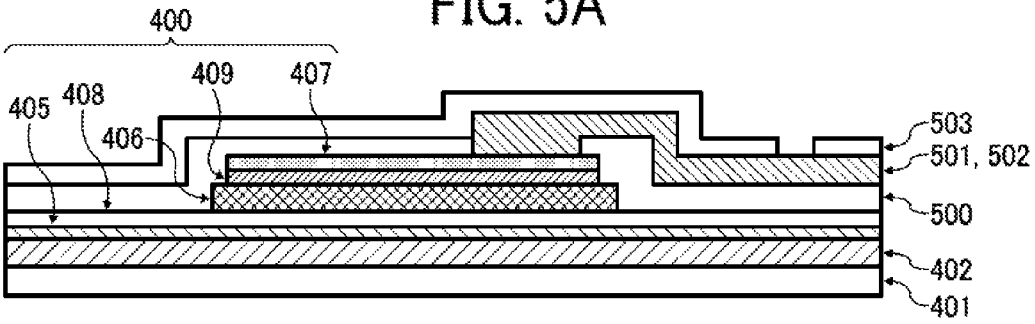
FIGS. 5A and 5B are illustrations cross-sectional views of an example of a configuration of an electromechanical transducer element of a droplet discharge head according to an embodiment of the present disclosure.
Figure 5B:
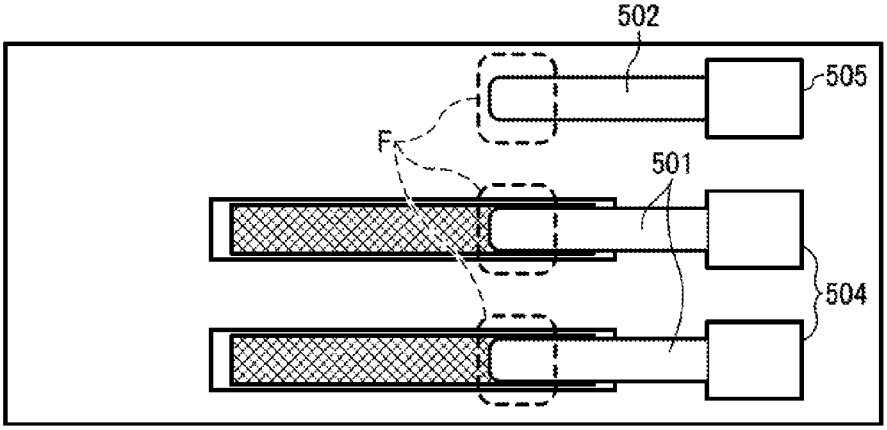

Here, a description is given of a detailed structure of the electromechanical transducer element including insulating protective films and lead wires. FIGS. 5A and 5B are illustrations of a configuration of the electromechanical transducer element including insulating protective films and lead wires. A first insulating protective film 500 includes contact holes in regions F indicated by broken lines in FIG. 5B. The first electrode 405 and the first oxide layer 408 are in electrical continuity with a fifth electrode (common electrode wiring) 501. The second electrode 407 and the second oxide layer 409 are in electrical continuity with a sixth electrode (individual electrode wiring) 502. A second insulating protective film 503 is disposed to protect the fifth electrode 501 and the sixth electrode 502. The second insulating protective film 503 is partially open, and electrode pads are disposed on opening. An electrode pad prepared for the fifth electrode 501 is a fifth electrode pad 504, and an electrode pad prepared for the sixth electrode 502 is a sixth electrode pad 505.

The first insulating protective film 500 has a function of, as a protective film, preventing damage to the electromechanical transducer element 400 in the steps of film formation and etching and also has a function of preventing permeation of moisture in the atmosphere. The film thickness of the first insulating protective film 500 is preferably thin, because if the film thickness is thick, the vibration displacement of the diaphragm would be hampered, thus reducing the discharging performance of the droplet discharge head. Therefore, fine inorganic materials, such as oxide, nitride, and carbide, are preferably selected as the materials of the first insulating protective film 500. Note that organic materials are not suitable for the materials of the first insulating protective film 500 because a sufficient protection performance is not obtained unless the film thickness is thick.

As the materials of the first insulating protective film 500, materials having good adhesion to the materials of the electrode as a base substrate, the electromechanical transducer film, and the diaphragm are preferably selected. As the method of film formation of the first insulating protective film 500, the plasma CVD method or the sputtering method is not preferable because the plasma CVD method and the sputtering method might give damage to the electromechanical transducer element, and for example, vapor deposition and the atomic layer deposition (ALD) method are preferable. The ALD method is more preferable in that the number of available materials is larger. For example, $Al_2O_3$, $ZrO_2$, $Y_2O_3$, $Ta_2O_3$, $TiO_2$ also used for materials of ceramics are available. By conducting the film formation according to the ALD method using such materials, a thin film can be produced at a quite high film density while effectively preventing damage in the steps of film formation and etching.

The film thickness of the first insulating protective film 500 is preferably in a range of not less than 20 nm and not greater than 100 nm. If the film thickness of the first insulating protective film 500 is greater than 100 nm, as described above, the discharging performance of the droplet discharge head would decrease. By contrast, if the film thickness of the first insulating protective film 500 is less than 20 nm, the function of the protective layer would decrease, thus reducing the performance of the electromechanical transducer element.

Alternatively, the first insulating protective film 500 may have a two-layer configuration. For example, in a configuration in which an insulating protective film of a first layer is thin and an insulating protective film of a second layer is thick, the insulating protective film of the second layer is configured to have an opening near the first oxide layer 408 so as not to hamper the vibration displacement of the diaphragm 402. In this configuration, as the insulation protective film of the second layer, any oxide, nitride, and carbide or a composite compound thereof can be used and $SiO_2$ generally used in a semiconductor device can be used. Any film formation method, such as the CVD method and the sputtering method, can be used for the film formation. However, for example, the CVD method allowing isotropic film formation is preferably used in consideration of stepwise coating at pattern formation portions, such as electrode formation portions.

The film thickness of the insulating protective film of the second layer is set to be in a range in which the insulation of the insulating protective film of the second layer is not broken by an electric field formed by a voltage applied to the fifth electrode 501 and the sixth electrode 502. In consideration of, for example, the surface state or a pinhole in the base of the first insulating protective film 500, the film thickness of the first insulating protective film 500 is preferably not less than 200 nm and more preferably not less than 500 nm.

A material of the fifth electrode 501 and the sixth electrode 502 is preferably a metal electrode material made of any one of an Ag ally, Cu, Al, Au, Pt, and Ir. As the fifth electrode 501 and the sixth electrode 502, desired patterns are obtained by forming a film according to the sputtering method or the spin coating method and conducting photolithoetching on the film. The film thickness of each of the fifth electrode 501 and the sixth electrode 502 is preferably not less than 0.1 μm and not greater than 20 μm and is more preferably not less than 0.2 μm and not greater than 10 μm. If the film thickness is less than 0.2 μm, the resistance of the film would increase and hamper flowing of a sufficient current to the electrode, thus hampering stable discharge of the droplet discharge head. By contrast, if the film thickness is greater than 10 μm, the time of processing the electrode would increase.

In addition, the contact resistance of the fifth electrode 501 in a contact hole portion (for example, 10 μm×10 μm) is preferably not greater than 10Ω, and the contact resistance of the sixth electrode 502 in a contact hole portion is preferably not greater than 1Ω. More preferably, the contact resistance of the fifth electrode 501 is not greater than 5Ω and the contact resistance of the sixth electrode 502 is not greater than 0.5Ω. If the contact resistance of the fifth electrode 501 is greater than 1052 or the contact resistance of the sixth electrode 502 is greater than 1Ω, sufficient electric current would not be supplied to the electrode, thus reducing the discharging performance of the droplet discharge head.

The second insulating protective film 503 acts as a protective layer to protect the sixth electrode 502 and the fifth electrode 501. As a material of the second insulating protective film 503, any inorganic material and any organic material can be used. However, a material with low moisture permeability is preferably selected. Examples of the inorganic material include oxide, nitride, and carbide. Examples of the organic material include polyimide, acrylic resin, and urethane resin. However, for such organic material, the film preferably has a relatively thick film thickness, which is disadvantageous for patterning. Therefore, inorganic material is more preferably selected. Among inorganic materials, particularly, $Si_3N_4$, which is widely used on Al wiring in semiconductor devices, is preferably used. The film thickness of the second insulating protective film 503 is preferably not less than 200 nm, and more preferably not less than 500 nm. If the film thickness is thin, sufficient passivation performance would not be achieved and a break in wiring due to corrosion of the sixth electrode 502 and the fifth electrode 501 would be likely to occur, thus resulting in a reduction in reliability of the droplet discharge head.

Opening is preferably provided above the electromechanical transducer element 400 and the diaphragm 402 around the electromechanical transducer element 400. This is because of the same reason as a reason that the regions of the first insulating protective film 500 corresponding to the individual chambers are formed thin. Such a configuration allows enhancement of the discharging performance and reliability of the droplet discharge head. The piezoelectric element is protected with the first insulating protective film 500 and the second insulating protective film 503, thus allowing the opening to be formed by photolithography and dry etching.

The area of each of the fifth electrode pad 504 and the sixth electrode pad 505 is preferably not less than 50×50 $\mu m^2$ and more preferably not less than 100×300 $\mu m^2$. If the area of each of the fifth electrode pad 504 and the sixth electrode pad 505 is less than 50×50 $\mu m^2$, polarization processing would not be sufficiently performed. Accordingly, when the electromechanical transducer element is continuously driven as the piezoelectric actuator, the strain deformation after the driving would gradually decrease than at the initial stage, thus causing a failure in durability.

Figure 6:
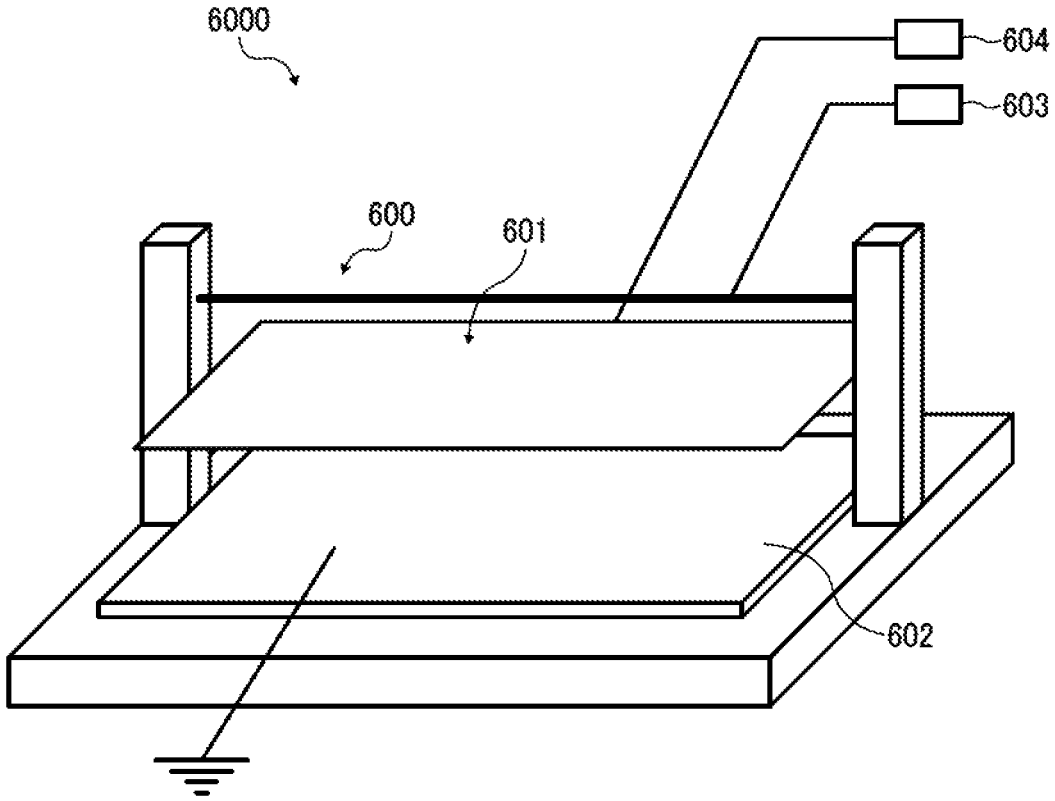
FIG. 6 is a perspective view of an example of a configuration of a polarization processing device.

For the piezoelectric element produced as described above, polarization processing is performed with a polarization processing device. The polarization processing reduces occurrence of failure due to continuous driving, thus preventing strain deformation from decreasing after the driving than at the initial stage. FIG. 6 is an illustration of a configuration of a polarization processing device. In FIG. 6, a polarization processing device 6000 includes a corona electrode 600, a grid electrode 601, and a stage 602 on which a sample is set. The corona electrode 600 is connected to a corona power supply 603. The grid electrode 601 is connected to a grid electrode power supply 604. The stage 602 has a function of temperature regulation. With the function of temperature regulation, the polarization processing device 6000 can perform polarization processing under a maximum temperature of about 350° C. The stage 602 is electrically grounded. When a high voltage is applied to the corona electrode 600, the grid electrode 601 is mesh-processed so that ion and charges generated by the corona electrode 600 efficiently falls onto the sample on the stage 602. The intensity of corona discharge is adjustable by changing the voltage applied to the corona electrode 600 or the grid electrode 601 and the distance between the sample and each electrode.

Figure 7A:
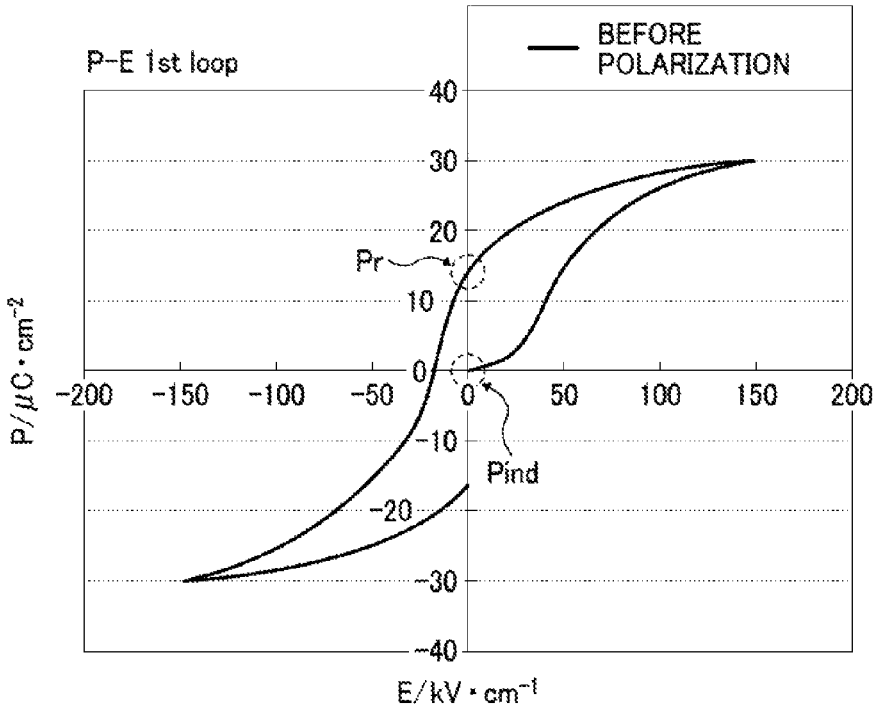
FIGS. 7A and 7B are graph charts of P-E hysteresis curves.
Figure 7B:
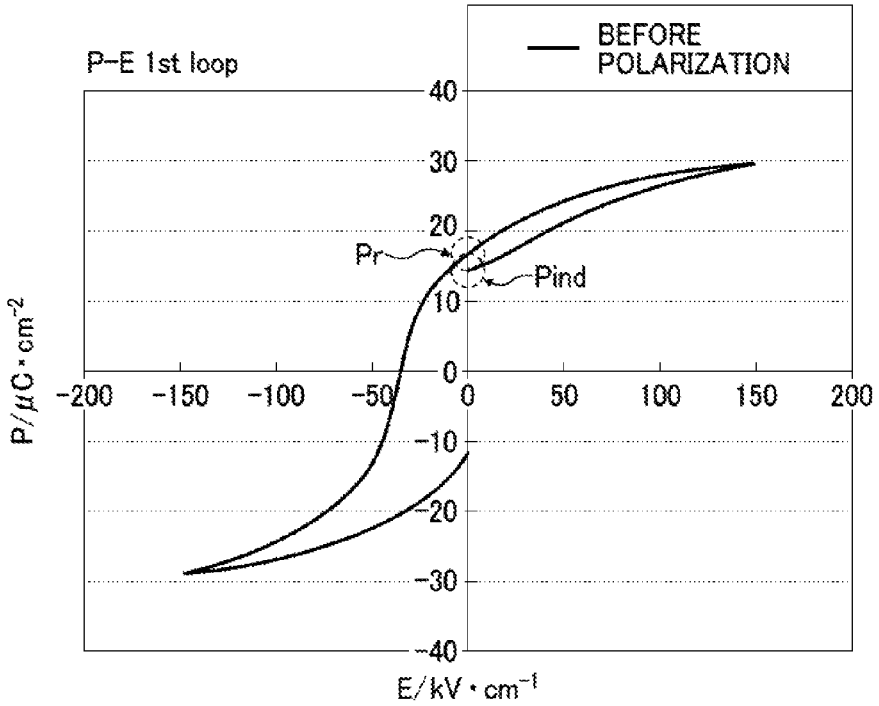

A state of polarization by polarization processing is determined from a P-E hysteresis loop illustrated in FIGS. 7A and 7B. A hysteresis loop is measured by applying an electric field of an intensity of ±150 kV/cm to the electromechanical transducer film. In FIGS. 7A and 7B, $P_{ind}$ represents an initial state of polarization at 0 kV/cm and Pr represents a state of polarization at 0 kV/cm when the voltage is returned from +150 kV/cm to 0 kV/cm after the voltage of +150 kV/cm is applied. A value of $P_r-P_{ind}$, that is, a value obtained by subtracting $P_{ind}$ from $P_r$ is defined as a polarization rate. The state of polarization is determined from the polarization rate.

As illustrated in FIG. 7A, before polarization processing, the polarization rate is about 15 $\mu C/cm^2$. By contrast, as illustrated in FIG. 7B, after polarization processing, the polarization rate is about 2 $\mu C/cm^2$. The polarization rate is preferably not greater than 10 $\mu C/cm^2$, and more preferably not greater than 5 $\mu C/cm^2$. For the piezoelectric element produced as described above, polarization processing is performed with the polarization processing device 6000. The polarization processing reduces occurrence of failure due to continuous driving, thus preventing strain deformation from decreasing after the driving than at the initial stage.

Figure 8:
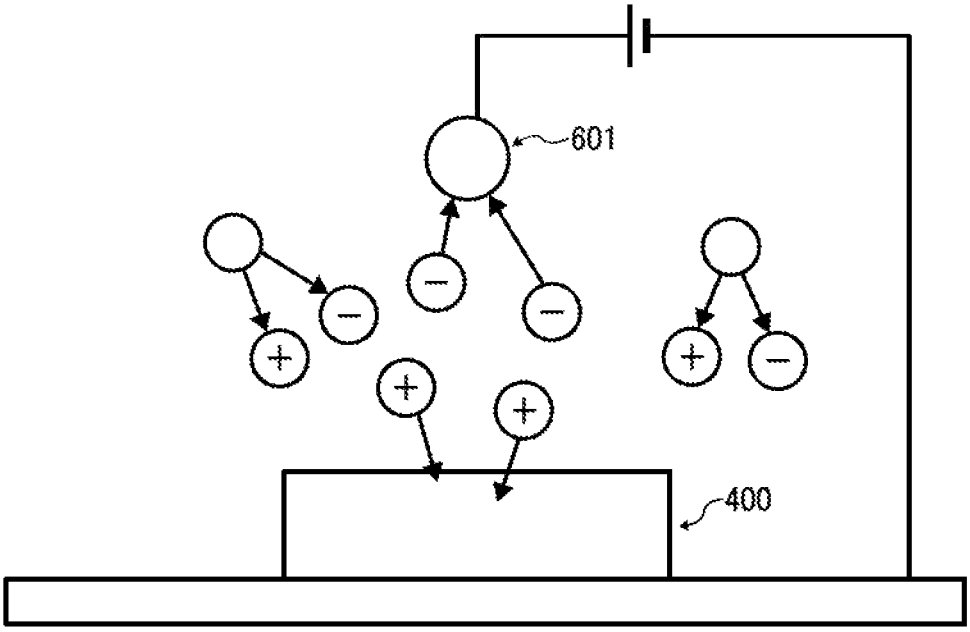
FIG. 8 is an illustration a principle of polarization processing.

As illustrated in FIG. 8, if corona discharge is generated with the corona electrode 600, atmospheric molecules are ionized and positive ions are generated. The positive ions flow into the electromechanical transducer element 400 via the fifth electrode pad 504 (see FIG. 5B), and charges are accumulated in the electromechanical transducer element 400. In the electromechanical transducer element 400 illustrated in FIG. 5A, a difference in the amount of charge accumulated between the second electrode 407 as the upper electrode and the first electrode 405 as the lower electrode causes a difference in potential between an upper portion and a lower portion of the electromechanical transducer element 400, thus allowing polarization processing. The amount Q of charge required for polarization processing is preferably not less than 1E-8 C, and more preferably not less than 4E-8 C. If the charge amount Q is less than 1E-8 C, polarization processing is not sufficiently performed. Accordingly, when the electromechanical transducer element is continuously driven as the actuator, sufficient strain displacement property is not obtained.

Next, examples of embodiments of the present disclosure are described together with comparative examples.

Example 1

A diaphragm was formed on a 6-inch silicon wafer as the substrate. In the diaphragm, an transverse (of a film thickness of about 600 nm), an Si film (of a film thickness of about 200 nm), an $SiO_2$ film (of a film thickness of about 100 nm), an SiN film (of a film thickness of about 150 nm), an $SiO_2$ film (of a film thickness of about 130 nm), an SiN film (of a film thickness of about 150 nm), an $SiO_2$ film (of a film thickness of about 100 nm), an Si film (of a film thickness of about 200 nm), and an $SiO_2$ film (of a film thickness of about 600 nm) were laminated in turn one on another. On the diaphragm film, a Ti film (of a film thickness of about 20 nm) was formed by the sputtering method under 350° C. and thermally oxidized by rapid thermal annealing (RTA) under 750° C. Then, a Pt film (of a film thickness of about 160 nm) as the first electrode (the lower electrode) was formed by the sputtering method under about 300° C. A $TiO_2$ film obtained by thermally oxidizing the Ti film acts as a adhesion layer interposed between the $SiO_2$ film and the Pt film.

Next, as a material of a $PbTiO_3$ (PT) layer that is the first oxide layer as a base layer of a PZT film, PT coating liquid was prepared in a composition ratio of Pb:Ti=1:1. In addition, as a material of the PZT film, PZT precursor coating liquid was prepared in a composition ratio of Pb:Zr:Tl=115:49:51. For example, the PZT precursor coating liquid was synthesized as follow. First, lead acetate trihydrate, titanium isopropoxide, and zirconium isopropoxide were used as starting materials for the sol-gel liquid. Crystal water of lead acetate was dissolved in methoxyethanol and was then dehydrated. The amount of lead is excessively large for a stoichiometric composition. This is to prevent reduction in crystallinity by so-called lead missing during heat treatment. The titanium isopropoxide and the zirconium isopropoxide were dissolved in methoxyethanol, an alcohol exchange reaction and an esterification reaction were advanced, a resultant was mixed with a methoxyethanol solution having dissolved the lead acetate, and the PZT precursor coating liquid was synthesized. In this example, the PZT concentration was set to 0.5 mol/l. The PT coating liquid was synthesized in the same manner as the PZT precursor coating liquid.

Using the coating liquids, first, the PT layer was formed by spin coating and drying was performed under 120° C. with a hot plate. The PZT film was formed by spin coating, and drying (120° C.) and thermal decomposition (400° C.) were performed with the hot plate. The series of processing of the coating, drying, and thermal decomposition of the PZT precursor coating liquid was repeated three times to form three layers. After the thermal decomposition on a third layer was finished, heat treatment (temperature of 730° C.) for crystallization was executed by RTA. When the heat treatment for crystallization was finished, the film thickness of the PZT film was 240 nm. The above-described process of the series of application, drying, and thermal decomposition of the PZT precursor coating liquid and the heat treatment for crystallization was repeated a total of eight times (24 layers), and a PZT film having a film thickness of about 2.0 μm was obtained.

Next, on the PZT film thus obtained, an $SrRuO_3$ film (of a film thickness of 40 nm) as the second oxide layer and a Pt film (of a film thickness of 125 nm) as the second electrode (the upper electrode) are formed by the sputtering method. Then, a film was formed by the spin coating method using a photoresist (TSMR8800) manufactured by TOKYO OHKA KOGYO, LTD, and a pattern illustrated in FIG. 8 was formed by photolithography and etching. Note that etching was performed with an inductively coupled plasma (ICP) etching apparatus manufactured by SAMCO Inc.

Following the pattern formation, an $Al_2O_3$ film (of a film thickness of 50 nm) as the first insulating protective film was formed by the ALD method. As raw materials of the $Al_2O_3$ film, TMA (manufactured by Sigma-Aldrich Co. LLC.) was used for Al, and $O_3$ generated by an ozone generator was used for 03. Then, film formation was advanced by alternately stacking Al and $O_3$. In the first insulating protective film, contact holes were formed by etching. AL layers serving as the fifth electrode and the sixth electrode were formed by the sputtering method. After a pattern was formed on each AL layer by photolithography and etching, an $Si_3N_4$ layer (of a film thickness of 500 nm) as the second insulating protective film is formed by the plasma CVD method.

Then, polarization processing was executed by corona charging. In the corona charging, tungsten wire of ϕ50 μm was used. Polarization processing conditions were a processing temperature of 80° C., a corona voltage of 9 kV, a grid voltage of 2.5 kV, a processing time of 30 seconds, a distance between the corona electrode and the grid electrode to be 4 mm, and the distance between the grid electrode and the stage to be 4 mm. The distance between the two electrode pads was 80 μm.

Finally, pressurization chambers (of the width of about 60 μm) were formed in the substrate by anisotropic wet etching using alkaline solution (KOH solution or TMHA solution). Thus, a droplet discharge head including piezoelectric actuators (thin-film PZT actuators) as electromechanical piezoelectric elements were produced.

Example 2

A droplet discharge head was produced in the same manner as Example 1 except for the following two points. One is that the film thickness of the Ti film formed on the $SiO_2$ film as the diaphragm was set to about 50 nm. The other is that the temperature of thermal decomposition after the formation of the PZT film was set to 350° C.

Example 3

A droplet discharge head was produced in the same manner as Example 1 except for the following points. One is that the film thickness of the Ti film formed on the $SiO_2$ film as the diaphragm was set to about 50 nm. Another is that the temperature of film formation of the Ti film was set to 500° C. The other is that the temperature of thermal decomposition after the formation of the PZT film was set to 350° C.

Example 4

A droplet discharge head was produced in the same manner as Example 1 except for the following points. One is that the temperature of film formation of the Ti film on the $SiO_2$ film as the diaphragm was set to 500° C. Another is that the drying temperature after the formation of the PZT film was set to 140° C. The other is that the temperature of thermal decomposition after the formation of the PZT film was set to 350° C.

Example 5

A droplet discharge head was produced in the same manner as Example 1 except for the following points. One is that the film thickness of the Ti film formed on the $SiO_2$ film as the diaphragm was set to about 50 nm. The other is that the temperature of film formation of the Ti film was set to 500° C.

Example 6

A droplet discharge head was produced in the same manner as Example 1 except for the following points. One is that the temperature of film formation of the Ti film on the $SiO_2$ film as the diaphragm was set to 500° C. The other is that the drying temperature after the formation of the PZT film was set to 140° C.

Comparative Example 1

A droplet discharge head was produced in the same manner as Example 1 except for the following point. The point is that, after the film formation of the Ti film on the $SiO_2$ film as the diaphragm, a $TiO_2$ layer as a base layer was formed with a film thickness of 5 nm by the sputtering method, instead of the $PbTiO_3$ layer as the first oxide layer.

Comparative Example 2

A droplet discharge head was produced in the same manner as Example 4 except that the polarization processing by corona charging is not performed.

For each of the droplet discharge heads of Examples 1 through 6 and Comparative Examples 1 and 2 with the back face side of the substrate drilled, strain deformation (piezoelectric constant) was evaluated in an initial state and a state immediately after a durability test of the electromechanical transducer element. In the durability test, after an initial piezoelectric constant was evaluated, the application of voltage was repeated $10^{10}$ times. For the piezoelectric constant, the amount of strain deformation of the electromechanical transducer element when the electric field of 150 kV/cm is formed by the application of voltage is measured from the back face side of the substrate with a laser Doppler vibrometer, and calculated by adjusting the measurement results through simulations. In addition, the radius of curvature of deflection of the diaphragm was also measured. The radius of curvature of deflection of the diaphragm was measured with a white-light interference type profilometer.

For the PZT film of the electromechanical transducer element of each of Examples 1 through 6 and Comparative Examples 1 and 2, evaluation results are shown in FIG. 1.

TABLE 1

| | Radius of Curvature | Piezoelectric Constant (d31) [pm/V] | |
|---|---|---|---|
| | [μm] | Initial State | After $10^{10}$ repeats |
| Example 1 | 3312 | −130 | −127 |
| Example 2 | 3041 | −130 | −126 |
| Example 3 | 3561 | −136 | −126 |
| Example 4 | 3728 | −152 | −139 |
| Example 5 | 4064 | −145 | −136 |
| Example 6 | 3336 | −139 | −134 |
| Comparative Example 1 | 1766 | −118 | −112 |
| Comparative Example 2 | 6250 | −160 | −99 |

In any of Examples 1 through 6, the radius of curvature of deflection of the diaphragm is in a range not less than 2500 μm and not greater than 4500 μm. For Comparative Example 1, the radius of curvature is 1766 μm, which is less than 2000 μm. For Comparative example 2, the radius of curvature is 6250 μm, which is greater than 6000 μm.

For Examples 1 through 6, the initial piezoelectric constant and the piezoelectric constant after the durability test have properties equivalent to properties of a general ceramic sintered body (that the piezoelectric constant is in a range of from −120 pm/V to −160 pm/V). By contrast, for Comparative Example 1, the initial piezoelectric constant is −118 pm/V and the piezoelectric constant after the durability test is 112 pm/V, both of which are outside the range of from −120 pm/V to −160 pm/V. In other words, Comparative Example 1 is inferior in the properties of durability to a general ceramic sintered body, which is problematic in actual use.

For Comparative example 2, the initial piezoelectric constant is −160 pm/V, which is in the range of from −120 pm/V to −160 pm/V. However, the piezoelectric constant after the durability test is −99 pm/V, which is far from the range of from −120 pm/V to −160 pm/V. In other words, Comparative Example 2 is quite inferior in the properties of durability to a general ceramic sintered body, which is problematic in actual use.

Figure 9:
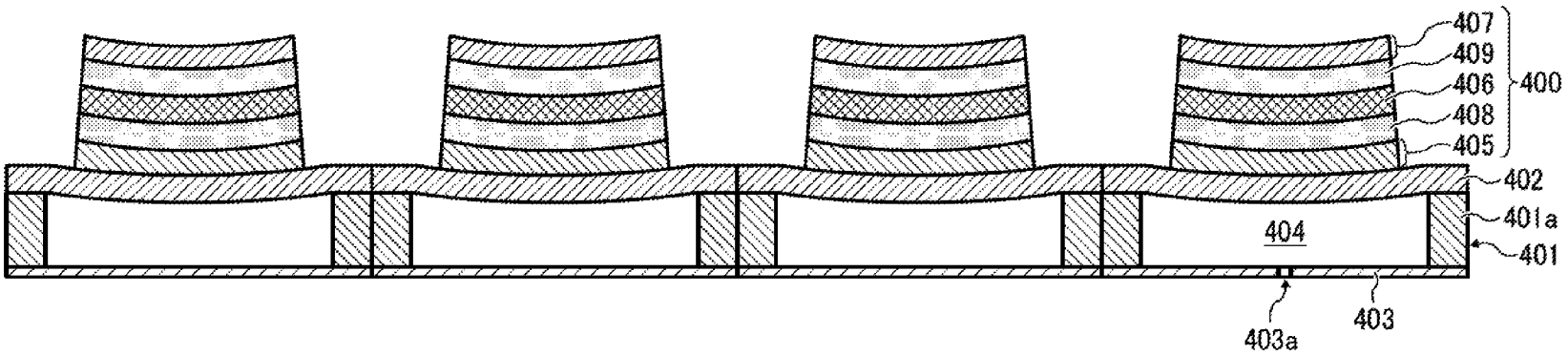
FIG. 9 is a cross-sectional view of a configuration example in which a plurality of liquid discharge heads are arranged.

Here, an example of a configuration in which a plurality of liquid discharge heads including piezoelectric actuators with PZT films are arranged is described below. FIG. 9 is a cross-sectional view of the configuration example in which a plurality of liquid discharge heads including the piezoelectric actuator with the PZT film 406 illustrated in FIG. 1 are arranged. According to the configuration example of FIG. 9, the piezoelectric actuator as the electromechanical transducer element can be formed by a simple production process so as to have a performance equivalent to a bulk ceramics. In addition, the removal etching from the back face for the subsequent formation of pressurization chambers and the bonding of the nozzle plate having nozzle orifices are performed, thus allowing a plurality of liquid discharge heads to be collectively formed. In FIG. 9, a liquid supply unit, channels, and fluid resistance portions are not illustrated.

liquid discharge heads having the configuration illustrated in FIG. 9 were produced using the electromechanical transducer elements prepared in Examples 1 through 6, and were evaluated for the discharging performance of ink. In this evaluation, ink having a viscosity of 5 cp was used. A voltage of from −10V to −30V was applied by a simple push waveform, and the state of discharging ink from nozzle orifices was checked. As a result, in any of Examples 1 through 6, it was found that ink was successfully discharged from all nozzle orifices.

Next, an inkjet recording apparatus as an image forming apparatus (droplet discharge device) mounting a droplet discharge head according to an embodiment of the present disclosure is described below.

Figure 10:
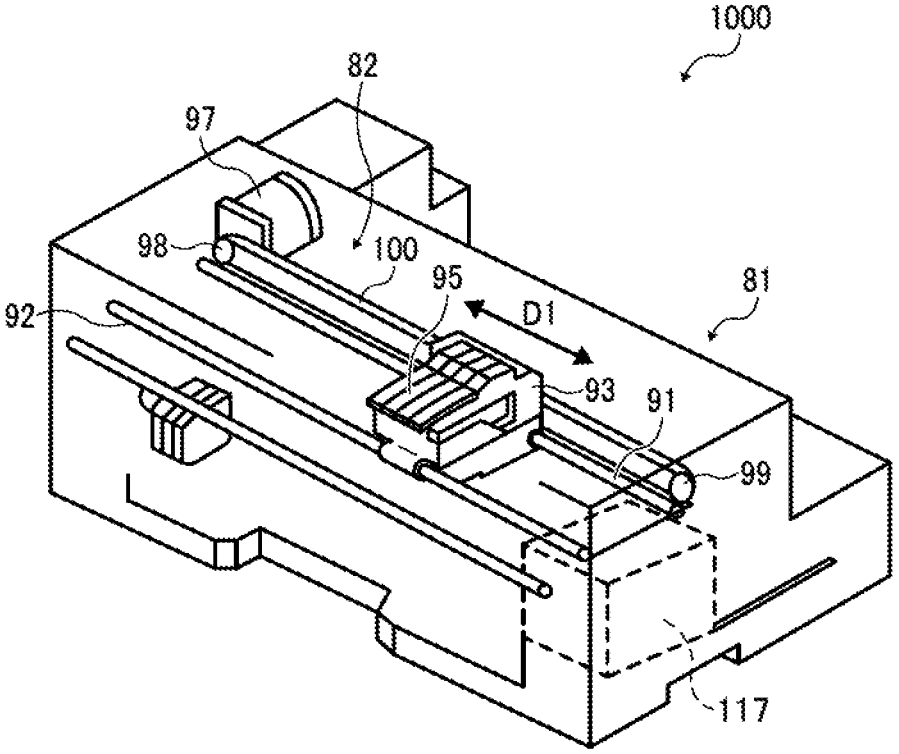
FIG. 10 is a perspective view of an example of an inkjet recording apparatus including the droplet discharge head according to an embodiment of the present disclosure.
Figure 11:
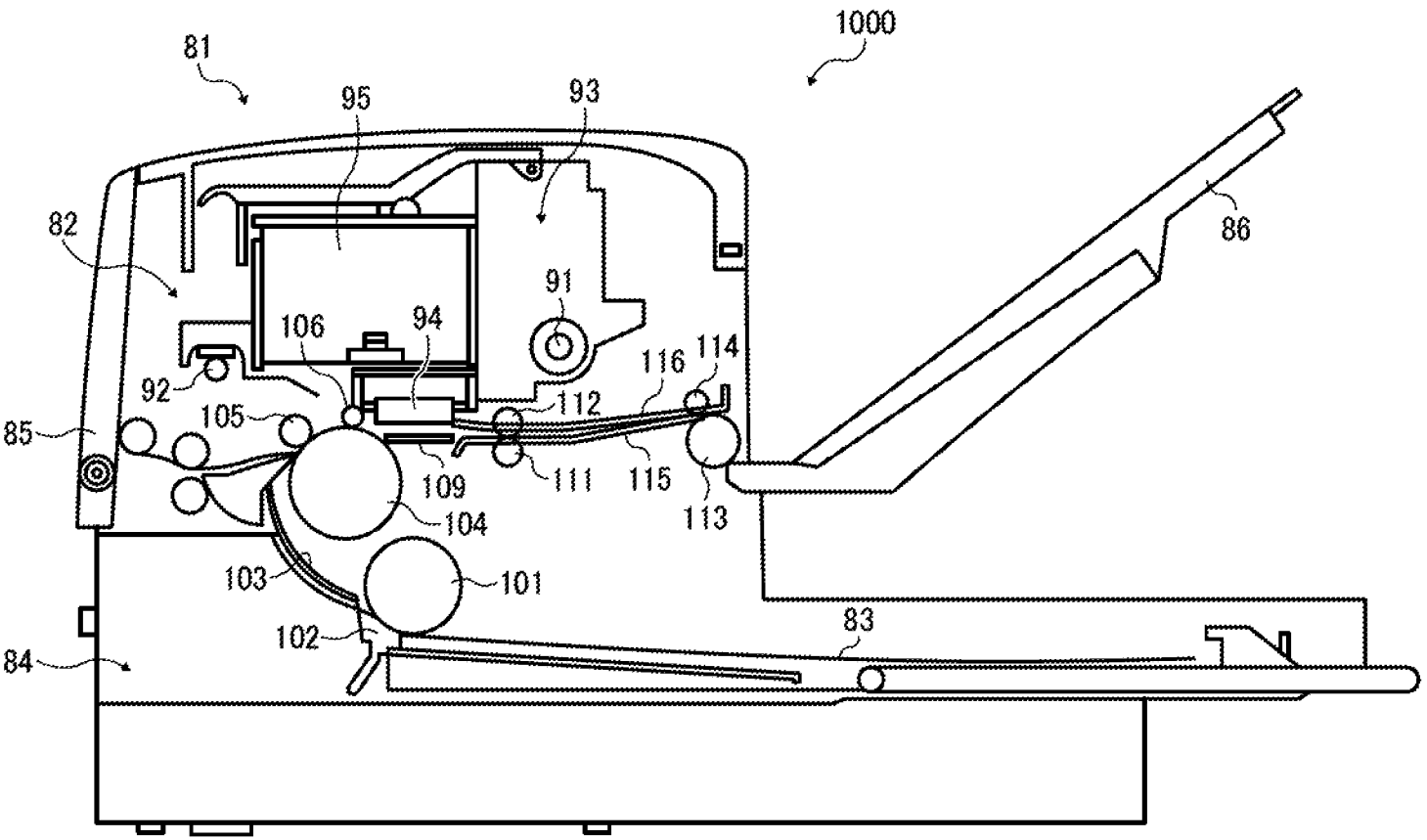
FIG. 11 is an illustration of a mechanical section of the inkjet recording apparatus of FIG. 10.

FIG. 10 is a perspective view of an example of the inkjet recording apparatus according to this embodiment. FG. 11 is a side view of a mechanical section of the inkjet recording apparatus of FIG. 10. An inkjet recording apparatus 1000 according to this embodiment includes, e.g., a printing assembly 82 inside a recording apparatus body 81. The printing assembly 82 includes, e.g., a carriage 93 movable in a main-scanning direction indicated by arrow D1 in FIG. 10, ink cartridges 95 serving as liquid cartridges to supply ink, which is liquid for image formation, to a plurality of droplet discharge heads 94 mounted in the carriage 93. In a lower portion of the recording apparatus body 81, a sheet feeding cassette 84 (or sheet feeding tray) capable of loading sheets 83 as a large number of sheets of recording media can be mounted to be freely inserted or extracted from the front side. In addition, a bypass tray 85 for manually feeding sheets 83 is disposed to be tiltable to open. When a sheet 83 fed from the sheet feeding cassette 84 or the bypass tray 85 is taken in, the printing assembly 82 records a desired image on the sheet 83. Then, the sheet 83 is ejected to a sheet ejection tray 86 mounted on a back face side of the recording apparatus body 81.

In the printing assembly 82, a main guide rod 91 and a sub-guide rod 92 as guides laterally bridged between left and right side plates support the carriage 93 slidably in the main-scanning direction D1. In the carriage 93, nozzles as a plurality of ink discharge ports are arrayed in a direction crossing the main-scanning direction D1, and the plurality of droplet discharge heads 94 is mounted so as to have a droplet discharge direction toward the lower side. The droplet discharge heads 94 are heads (inkjet heads) to discharge droplets of colors of yellow (Y), cyan (C), magenta (M), and black (Bk). In addition, the ink cartridges 95 to supply ink of the respective colors to the droplet discharge heads 94 are replaceably mounted on the carriage 93.

Each of the ink cartridges 95 includes an air communication port communicated with the atmosphere in an upper portion of each ink cartridge 95, an ink supply port in a lower portion of each ink cartridge 95, and a porous body to be filled with ink inside each ink cartridge 95. In each ink cartridge 95, liquid (ink) to be supplied to each droplet discharge head 94 is maintained in slightly negative pressure by capillary force of the porous body. In this embodiment, the four droplet discharge heads 94 are used corresponding to the respective colors. However, in some embodiments, for example, a single droplet discharge head having a plurality of nozzles that discharge droplets of different colors may be used.

Note that a rear side (downstream of a sheet conveyance direction) of the carriage 93 is slidably fitted to the main guide rod 91, and a front side (upstream of the paper conveyance direction) of the carriage 93 is slidably fitted to the sub-guide rod 92. To move the carriage 93 for scanning in the main-scanning direction D1, a timing belt 100 is stretched taut between a driving pulley 98 rotated by a main scanning motor 97 and a driven pulley 99. The timing belt 100 is secured to the carriage 93, and the carriage 93 is driven to reciprocate according to forward and reverse rotation of the main scanning motor 97.

To convey sheets 83 set in the sheet feeding cassette 84 to a position below the droplet discharge heads 94, the inkjet recording apparatus 1000 also includes a sheet feeding roller 101, a friction pad 102, a sheet guide 103, a conveyance roller 104, a conveyance roller 105, and a leading end roller 106. The sheet feeding roller 101 and the friction pad 102 separate and feed a sheet 83 from the sheet feeding cassette 84, and the sheet guide 103 guides the sheet 83. The conveyance roller 104 turns over and conveys the fed sheet 83. The leading end roller 106 defines the feed angle of the sheet 83 from the conveyance roller 104 and the conveyance roller 105 pressed to the peripheral face of the conveyance roller 104. The conveyance roller 104 is driven to rotate by a sub-scanning motor 107 via a gear train.

A print receiver 109 as a sheet guide is provided to guide the sheet 83 fed from the conveyance roller 104 below the droplet discharge heads 94 in accordance with the movement range of the carriage 93 in the main-scanning direction D1. On the downstream side of the print receiver 109 in the sheet conveyance direction are disposed a conveyance roller 111 and a spur roller 112 that are driven to rotate so as to feed the sheet 83 in a sheet ejecting direction. The inkjet recording apparatus 1000 further includes a sheet ejection roller 113 and a spur roller 114 to feed the sheet 83 to the sheet ejection tray 86 and guides 115 and 116 constituting a sheet ejection passage.

In recording, the inkjet recording apparatus 1000 drives the droplet discharge heads 94 in response to image signals while moving the carriage 93, discharges ink to the stopped sheet 83 to record one line of a desired image on the sheet 83, feeds the sheet 83 in a predetermined amount, and then records a next line on the sheet 83. When the inkjet recording apparatus 1000 receives a signal indicating that a rear end of the sheet 83 has reached a recording area, the inkjet recording apparatus 1000 terminates a recording operation, and ejects the sheet 83.

In addition, a recovery device 117 to recover discharge failure of the droplet discharge heads 94 is disposed at a position outside from a recording area at the right end side of a direction of movement of the carriage 93 in FIG. 10. The recovery device 117 includes a capping device, a suction device, and a cleaning device. The carriage 93 moves to the side of the recovery device 117 in a printing standby mode, the droplet discharge heads 94 are capped by the capping device. Thus, the nozzles as discharge ports are maintained in a wet state, thus preventing occurrence of discharge failure due to ink dry. In addition, for example, during recording, ink not relating to the recording is discharged to maintain the ink viscosity in all discharge ports constant, thus maintaining stable discharging performance.

When the discharge failure occurs, the discharge ports (nozzles) of the droplet discharge heads 94 are sealed by the capping device and ink and bubbles are sucked from the discharge ports by the suction device through a tube. The cleaning device removes ink and dusts adhered to a discharge port face, thus recovering the discharge failure. In addition, the sucked ink is drained to a waste ink container disposed on a lower portion of the recording apparatus body 81, is absorbed into an ink absorber in the waste ink container, and is held in the ink absorber.

As described above, the droplet discharge heads according to any of the above-described embodiment and Examples 1 through 6 are mountable in the inkjet recording apparatus. Such a configuration obtains stable ink droplet discharge properties without discharge failure due to drive failure of the diaphragm, thus enhancing image quality.

The above-described embodiment and Examples 1 through 6 are limited examples, and the present disclosure includes, for example, the following aspects having advantages.

Aspect A

A droplet discharge head includes a nozzle, such as the nozzle 403*a*, to discharge droplets; a substrate, such as the substrate 401, including a pressurization chamber, such as the pressurization chamber 404, communicated with the nozzle; a diaphragm, such as the diaphragm 402, on the substrate; and an electromechanical transducer element, such as the electromechanical transducer element 400, on the diaphragm. The electromechanical transducer element includes an electromechanical transducer film, such as the PZT film 406, including a piezoelectric material; a lower electrode, such as the first electrode 405, below the electromechanical transducer film, to apply voltage to the electromechanical transducer film; and an upper electrode, such as the second electrode 407, above the electromechanical transducer film, to apply voltage to the electromechanical transducer film. The diaphragm includes an $SiO_2$ film, an SiN film, and a Poly-Si film laminated one on another. The diaphragm has, in a direction of lamination, a thickness of not less than 1 μm and not greater than 3 μm. The diaphragm has a deflection projecting toward the pressurization chamber with no voltage applied to the electromechanical transducer film. A radius of curvature of the deflection in a transverse direction of the diaphragm is in a range of not less than 2000 μm and not greater than 6000 μm. To obtain a sufficient level of droplet discharging performance in driving a droplet discharge head at high frequency, the residual vibration of the diaphragm plate in discharging droplets is preferably reduced. The droplet discharge head cannot shift to the next ink discharge operation until the residual vibration occurring in driving the droplet discharge head at high frequency sufficiently decays. Accordingly, if the residual vibration of the diaphragm plate is not reduced, the droplet discharge head would have a difficulty in repeating discharge of ink droplets. Enhancement of the rigidity of the diaphragm allows a reduction in the residual vibration. Since the rigidity of the diaphragm depends on materials used and the film thickness of the diaphragm, using highly-rigid materials or increasing the film thickness of the diaphragm allows enhancement of the rigidity of the diaphragm. For example, through experiments, the inventor has found that, when the film thickness of the diaphragm formed by laminating an $SiO_2$ layer, an SiN layer, and a Poly-Si layer has a film thickness of not less than 1 μm, a sufficient rigidity of the diaphragm is obtained to reduce the residual vibration of the diaphragm. The inventor has also found that, if the film thickness of the diaphragm is greater than 3 μm, the diaphragm is less deformed, thus hampering stable droplet discharge of the droplet discharge head. The higher the rigidity of the diaphragm, the less the residual vibration of the diaphragm. However, as the diaphragm less vibrates, the amount of displacement of the electromechanical transducer element decreases. In other words, as the diaphragm has the above-described configuration to increase the rigidity of the diaphragm, the amount of displacement of the electromechanical transducer element decreases. Through experiments, the inventor has found that the amount of displacement of the electromechanical transducer element influences not only the rigidity of the diaphragm but also the amount of deflection of the diaphragm in the transverse direction in a state in which no voltage is applied to the electromechanical transducer film. For example, as the amount of deflection of the diaphragm in the transverse direction is set to be smaller, the amount of displacement of the electromechanical transducer element increases. As the amount of deflection of the diaphragm in the transverse direction is set to be greater, the amount of displacement of the electromechanical transducer element decreases. In the droplet discharge head having the above-described configuration of the diaphragm, the amount of deflection of the diaphragm in the transverse direction is preferably set to be small to some extent to obtain a sufficient large amount of displacement of the electromechanical transducer element to secure droplet discharging performance. The amount of deflection of the diaphragm in the transverse direction correlates with the radius of curvature of deflection of the diaphragm in the transverse direction. As the amount of deflection of the diaphragm in the transverse direction is small, the radius of curvature of deflection of the diaphragm in the transverse direction is large. In the droplet discharge head having the above-described configuration of the diaphragm, the radius of curvature of deflection of the diaphragm in the transverse direction is preferably set to be large to some extent to obtain a sufficient large amount of displacement of the electromechanical transducer element to secure droplet discharging performance. Through experiments of the droplet discharge head having the above-described configuration of the diaphragm, the inventor has found that, when the radius of curvature of deflection of the diaphragm in the transverse direction is set to be not less than 2000 μm, a sufficient large amount of displacement of the electromechanical transducer element is obtained to secure droplet discharging performance. In the droplet discharge head having the above-described configuration of the diaphragm, if the radius of curvature is greater than 6000 μm, the durability of the electromechanical transducer element decreases. The above-described configuration of the droplet discharge head having secures a sufficient droplet discharging performance even in driving at high frequency.

Aspect B

In the droplet discharge head of Aspect A, the $SiO_2$ film has a film thickness of not less than 600 μm and not greater than 2400 μm, the SiN film has a film thickness of not less than 100 μm and not greater than 500 μm, and the Poly-Si film has a film thickness of not less than 100 μm and not greater than 700 μm.

Aspect C

In the droplet discharge head according to Aspect A or B, the diaphragm has a Young's modulus of not less than 75 GPa and not greater than 95 GPa. Such a configuration allows the droplet discharge head to discharge droplets in driving at a high frequency (for example, a frequency of 32 kHz).

Aspect D

In the droplet discharge head according to any one of Aspects A through C, the electromechanical transducer film includes lead zirconate titanate (PZT) and has a film thickness of not less than 1 μm and not greater than 3 μm. If the film thickness of the electromechanical transducer film including PZT is smaller than 1 μm, the pressurization chamber 404 may not be easily processed. If the film thickness of the electromechanical transducer film is greater than 3 μm, the diaphragm that is a base of the electromechanical transducer film less deforms and displaces. Accordingly, a stable droplet discharge may not be obtained, and the diaphragm may not sufficiently displace.

Aspect E

In the droplet discharge head according to any one of Aspects A through D, the electromechanical transducer film has a value not less than 0.75 in $\rho\{100\}$, when $\rho\{100\}$ is represented by an equation of $\rho\{100\}=I\{hkl\}/\Sigma I$, where $I\{hkl\}$ represents an integral of diffraction intensity at a peak of diffraction intensity corresponding to an {hkl} plane of the electromechanical transducer film, and $\Sigma I$ represents a sum of integrals of diffraction intensities at peaks of diffraction intensity corresponding to planes for which the peaks of diffraction intensity of the electromechanical transducer film are to be obtained. When $\rho\{hkl\}$ is less than 0.75, the amount of displacement of the electromechanical transducer element is not sufficiently secured.

Aspect F

In the droplet discharge head according to any one of Aspects A through E, the electromechanical transducer element includes an insulating protective film including lead titanate ($PbTiO_3$) between the electromechanical transducer film and the lower electrode. Use of PZT in the electromechanical transducer film allows the electromechanical transducer film to be preferentially oriented to {100} plane. Through experiments, the inventor has found that Increasing the orientation rate of {100} plane on the electromechanical transducer film allows setting an increased radius of curvature of deflection of the diaphragm plate.

Aspect G

The droplet discharge head according to any one of Aspects A through F further includes an insulating protective film being an $Al_2O_3$ film formed by an atomic layer deposition (ALD) method. The insulating protective film has a film thickness of not less than 20 nm and not greater than 80 nm.

Aspect H

In the droplet discharge head according to any one of Aspects A through G, the pressurization chamber has a width of not less than 50 μm and not greater than 70 μm. When the width of the pressurization chamber is greater than 70 μm, the residual vibration of the diaphragm becomes large and may hamper securing the discharging performance of the droplet discharge head at high frequency. When the width of the pressurization chamber is less than 50 μm, the amount of displacement of the diaphragm decreases, thus hampering securing a sufficient level of discharging voltage.

Aspect I

In the droplet discharge head according to any one of Aspects A through H, the electromechanical transducer element has a value of not greater than 10 $\mu C/cm^2$ in $P_r-P_{ind}$, where $P_r-P_{ind}$ represents a value obtained by subtracting $P_{ind}$ from $P_r$, $P_{ind}$ represents a value of polarization at 0 kV/cm at an initial point in a measurement of hysteresis loop in a range of field intensity of ±150 kV/cm, Pr represents a value of polarization at 0 kV/cm when voltage is applied to the electromechanical transducer element from 0 kV/cm to +150 kV/cm and is returned from +150 kV/cm to 0 kV/cm. By conducting the polarization processing on the electromechanical transducer element produced to fully polarize the electromechanical transducer element, the occurrence of failure due to continuous driving is reduced, thus preventing strain deformation from decreasing after the driving than at the initial stage. The state of polarization (on whether the electromechanical transducer element has been sufficiently polarized by the polarization processing) is determined from a value of $P_r-P_{ind}$ (polarization rate), that is, a value obtained by subtracting $P_{ind}$ from $P_r$. When the polarization rate is not greater than 10 $\mu C/cm^2$, it is determined that the electromechanical transducer element has been sufficiently polarized.

Aspect J

An image forming apparatus includes the droplet discharge head according to any one of Aspects A through I.

Aspect K

A method of producing the droplet discharge head according to any one of Aspects A through I includes generating charge by corona discharge, and injecting the charge into the electromechanical transducer element to polarize the electromechanical transducer element.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

What is claimed is:

1. A droplet discharge head, comprising:

a nozzle to discharge droplets;

a substrate including a pressurization chamber communicated with the nozzle;

a diaphragm on the substrate; and an electromechanical transducer element on the diaphragm, the electromechanical transducer element including an electromechanical transducer film including a piezoelectric material;

a lower electrode below the electromechanical transducer film, to apply voltage to the electromechanical transducer film; and an upper electrode above the electromechanical transducer film, to apply voltage to the electromechanical transducer film, the diaphragm including an $SiO_2$ film, an SiN film, and a Poly-Si film laminated one on another, the diaphragm having, in a direction of lamination, a thickness of not less than 1 μm and not greater than 3 μm, the diaphragm having a deflection projecting toward the pressurization chamber with no voltage applied to the electromechanical transducer film, a radius of curvature of the deflection in a transverse direction of the diaphragm being in a range of not less than 2000 μm and not greater than 6000 μm, wherein the electromechanical transducer element has a value of not greater than 10 $\mu C/cm^2$ in $P_r-P_{ind}$, where $P_r-P_{ind}$ represents a value obtained by subtracting $P_{ind}$ from $P_r$, $P_{ind}$ represents a value of polarization at 0 kV/cm at an initial point in a measurement of hysteresis loop in a range of field intensity of ±150 kV/cm, $P_r$ represents a value of polarization at 0 kV/cm when voltage is applied to the electromechanical transducer element from 0 kV/cm to +150 kV/cm and is returned from +150 kV/cm to 0 kV/cm.

2. The droplet discharge head according to claim 1, wherein the $SiO_2$ film has a film thickness of not less than 600 μm and not greater than 2400 μm, wherein the SiN film has a film thickness of not less than 100 μm and not greater than 500 μm, wherein the Poly-Si film has a film thickness of not less than 100 μm and not greater than 700 μm.

3. The droplet discharge head according to claim 1, wherein the diaphragm has a Young's modulus of not less than 75 GPa and not greater than 95 GPa.

4. The droplet discharge head according to claim 1, wherein the electromechanical transducer film includes lead zirconate titanate and has a film thickness of not less than 1 μm and not greater than 3 μm.

5. The droplet discharge head according to claim 1, wherein the electromechanical transducer element includes an insulating protective film including lead titanate ($PbTiO_3$) between the electromechanical transducer film and the lower electrode.

6. The droplet discharge head according to claim 1, further comprising an insulating protective film being an $Al_2O_3$ film formed by an atomic layer deposition method, wherein the insulating protective film has a film thickness of not less than 20 nm and not greater than 80 nm.

7. The droplet discharge head according to claim 1, wherein the pressurization chamber has a width of not less than 50 μm and not greater than 70 μm in the transverse direction of the diaphragm.

8. An image forming apparatus, comprising the droplet discharge head according to claim 1.

9. A method of producing the droplet discharge head according to claim 1, the method comprising:

generating charge by corona discharge; and injecting the charge into the electromechanical transducer element to polarize the electromechanical transducer element.

10. A droplet discharge head, comprising:

a nozzle to discharge droplets;

a substrate including a pressurization chamber communicated with the nozzle;

a diaphragm on the substrate; and an electromechanical transducer element on the diaphragm, the electromechanical transducer element including an electromechanical transducer film including a piezoelectric material;

a lower electrode below the electromechanical transducer film, to apply voltage to the electromechanical transducer film; and an upper electrode above the electromechanical transducer film, to apply voltage to the electromechanical transducer film, the diaphragm including an $SiO_2$ film, an SiN film, and a Poly-Si film laminated one on another, the diaphragm having, in a direction of lamination, a thickness of not less than 1 μm and not greater than 3 μm, the diaphragm having a deflection projecting toward the pressurization chamber with no voltage applied to the electromechanical transducer film, a radius of curvature of the deflection in a transverse direction of the diaphragm being in a range of not less than 2000 μm and not greater than 6000 μm, wherein the electromechanical transducer film has a value not less than 0.75 in $\rho\{100\}$, where $\rho\{100\}$ is represented by an equation of $\rho\{100\}=I\{hkl\}/\Sigma I$, $I\{hkl\}$ represents an integral of diffraction intensity at a peak of diffraction intensity corresponding to an {hkl} plane of the electromechanical transducer film, and $\Sigma I$ represents a sum of integrals of diffraction intensities at peaks of diffraction intensity corresponding to planes for which the peaks of diffraction intensity of the electromechanical transducer film are to be obtained.

11. An image forming apparatus, comprising the droplet discharge head according to claim 10.

12. A method of producing the droplet discharge head according to claim 10, the method comprising:

generating charge by corona discharge; and injecting the charge into the electromechanical transducer element to polarize the electromechanical transducer element.

* * * * *